United States Patent [19]

van der Linden et al.

[11] 4,305,450

[45] Dec. 15, 1981

[54] APPARATUS FOR CHECKING THE OPERATION OF A PLURALITY OF LIQUID SPRAYS IN A CONTINUOUS CASTING APPARATUS

[75] Inventors: Gerardus A. van der Linden, Santpoort-Zuid; Mas van Slooten, Heemskerk, both of Netherlands

[73] Assignee: Hoogovens IJmuiden B.V., IJmuiduen, Netherlands

[21] Appl. No.: 97,188

[22] Filed: Nov. 26, 1979

[30] Foreign Application Priority Data

Dec. 1, 1978 [NL] Netherlands ..... 7811774

[51] Int. Cl.[3] ..... B22D 11/08; B22D 11/124; B22D 11/16

[52] U.S. Cl. ..... 164/150; 73/168; 73/432 PS; 164/425; 164/444

[58] Field of Search ..... 164/150, 414, 444; 73/861.73, 861.21, 432 PS, 168, 861.71

[56] References Cited

U.S. PATENT DOCUMENTS

| | | | |
|---|---|---|---|
| 3,608,370 | 9/1971 | Vollenweider et al. | 73/DIG. 4 |
| 3,665,226 | 5/1972 | Sinker et al. | 73/861.21 X |
| 3,797,319 | 3/1974 | Abe | 73/432 PS |
| 3,830,103 | 8/1974 | Andrjkovics et al. | 73/DIG. 4 |
| 3,939,709 | 2/1976 | Echtler | 73/861.73 |
| 4,058,012 | 11/1977 | Gauch | 73/861.73 |

FOREIGN PATENT DOCUMENTS

| | | | |
|---|---|---|---|
| 229569 | 10/1958 | Australia | 73/861.21 |
| 50-97379 | 8/1975 | Japan | 164/414 |
| 168951 | 4/1965 | U.S.S.R. | 73/432 PS |
| 554065 | 7/1977 | U.S.S.R. | 164/150 |

*Primary Examiner*—Robert D. Baldwin
*Assistant Examiner*—J. Reed Batten, Jr.
*Attorney, Agent, or Firm*—Stevens, Davis, Miller & Mosher

[57] ABSTRACT

Apparatus for continuous casting has pairs of rolls defining a path for the solidifying slab of steel. Between the rolls on each side are rows of spray nozzles. To check the operation of the sprays and thus achieve uniform cooling, checking apparatus carrying detectors for the sprayed water is passed through the path. To achieve a useful measure of the spraying efficiency the detectors must be highly sensitive and robust. Each detector has a metal diaphragm which is set in vibration by the sprayed water and a piezo-electric element fixed to the diaphragm so as to emit a signal whose amplitude is dependent on the amplitude of the vibration of the diaphragm.

10 Claims, 6 Drawing Figures

APPARATUS FOR CHECKING THE OPERATION OF A PLURALITY OF LIQUID SPRAYS IN A CONTINUOUS CASTING APPARATUS

BACKGROUND OF THE INVENTION

1. Field of the Invention

This invention relates to apparatus for checking the operation of a plurality of liquid sprays, especially for use in a continuous casting apparatus. The invention also relates to the continuous casting apparatus itself.

The invention will be described below mainly in connection with its application in a continuous casting machine. Nevertheless the invention may be applied in checking the functioning of liquid sprays which are incorporated in other installations where an object is moved in a path past the sprays, such as for example a rolling mill.

2. Description of the Prior Art

A continuous casting machine is used in the iron and steel industry for the conversion of liquid steel into a continuous slab for example 2,000 mm wide and 250 mm in thickness. The molten steel is cast into a mould which opens vertically downwardly into a track formed by a plurality of pairs of rolls. As it leaves the water-cooled mould, the slab already possesses a solidified skin; from the mould it is led through the track supported by the rolls and is intensively cooled by water sprays between the rolls. The thickness of the skin of the slab thus increases until finally the residual molten material in the heart of the slab has solidified. Thereafter the slab is divided.

When the continuous casting process is restarted for a new charge, a so-called starting chain or dummy bar is passed through the machine, at the head of the new slab.

Usually the roll track starts vertically and turns through 90° underneath the mould into a horizontal and straight portion. At the transition to this straight portion, the cast slab is pressed flat and subsequently is subjected to further cooling in the straight portion, so that the cast slab emerges horizontal and flat.

Continuous casting apparatus of this kind is known in the art, and further description is unnecessary.

With continuous casting machines designed for the casting of slabs with dimensions of 2,000 mm and 250 mm as mentioned above, the double roll track may typically comprise 50 to 100 pairs of rolls. Between each adjacent rolls on one side of the track there are 10 to 15 cylindrical aperture spray nozzles located on a support and distributed uniformly across the width of the track. In the following the entire spray support and the spray nozzles which it carries will be termed the spray system.

One major problem with known continuous casting machines is achieving correct operation of the spray systems. It may be that the location of a spray is not correct, for example the pipe to which the spray is connected is not correctly aligned or this pipe is bent, so that the original correct position of the spray has been lost. The result of this can be that the liquid is directed wholly or partially onto one of the two rolls between which the spray is located, instead of onto the slab surface. This results in wear of the expensive roll. It can also happen that the nozzles, as a result of particles entrained by the cooling water or lime deposits, become wholly or partially blocked. In all these cases the sprays do not function properly. The resultant irregular cooling of the slab surface can give rise to poor quality output, which is noticed only after some time has elapsed, when the slab is being subjected to further processing; in principle then all steel cast after the sprays ceased to function correctly is subject to the same shortcomings. If there is a larger concentration of inefficiently operating sprays and, consequently a delay in the solidification process, the skin of the slab can locally be too weak to retain the liquid steel and breakouts can occur. These result in breakdown of the continuous casting machine and loss of production.

One approach to solution of this problem which has been considered is to provide the supply pipe to each spray with a flow meter, in order to establish whether a spray is functioning and, if it is, how much liquid is being sprayed. This however will not detect a skew position of the spray or irregular spraying over the sprayed ingot.

It is also possible as a preventive measure regularly to replace all sprays in the double roll track by efficient sprays and to align the sprays. This however requires an inordinately long stoppage time during which the machine is out of service, with loss of production. Furthermore, information is not given as to whether the spray system is in good condition i.e. whether the cast slab is being efficiently cooled and to what extent the condition of the spray system is deteriorating during operation.

To avoid the problem of blockage of the nozzles by particles in the water or by deposition from the water, it has been proposed to use relatively large slot-shaped apertures in the nozzles, but these have the disadvantage that uniformity of spraying is difficult to achieve. Also the problem of misalignment of the sprays is not avoided. The description of the present invention in this specification is mainly directed to sprays having cylindrical nozzle apertures, though the invention is applicable to sprays having any shape of aperture.

Visual inspection of the operation of the sprays is possible, but is naturally slow, arduous and of insufficient precision.

Japanese published patent application no. 50-97379 (1975) proposes the use of a checking apparatus for the cooling sprays of a continuous casting machine, which apparatus comprises a carriage which is moved through the roll track by the dummy bar. The carriage carries a small number of "pressure-converting elements" (six are shown on each side) which are moved to and fro transversely of the carriage while the carriage is being moved through the roll track. These pressure converting elements are intended to measure the water spray pressure. It is stated that it is necessary for the elements to be moved to and fro, though elsewhere there is a statement that the number of elements may be increased so that they need not be moved. No details of the pressure-converting elements are given.

It is believed that the apparatus described in this Japanese patent application has not been developed successfully into an operational state. One reason for this may be that a device intended to measure the pressure exerted by sprayed water has to be extremely sensitive, and no such device suitable for operation in rugged conditions is known. The pressure of the sprayed water is as low as 40 Pascals, which is less than half the barometric pressure difference between the upper, inlet end of the roll track and the lower, horizontal outlet section. It seems that pressure-sensing devices are of inadequate sensitivity and are too slow in operation, for the present purpose. Additionally, the use of only six sensors, as illustrated in the Japanese application would produce insufficient information for the checking of a large number of sprays, unless perhaps the sensors are moved, as proposed in the Japanese application. Such movement however makes the measurement operation slow and technically complex.

SUMMARY OF THE INVENTION

The object of the invention is therefore to provide apparatus for checking the operation of liquid sprays which is sufficiently sensitive and is quick in operation.

Another object is to provide such apparatus which is sufficiently rugged to withstand the conditions obtaining in a continuous casting machine.

The invention proposes detection of the amplitude of the vibrations of a vibratable element on which the sprayed liquid is allowed to impinge. The amplitude of the vibration set up by the spray droplets is dependent on the number, size and velocity of the droplets and is therefore a measure of the cooling effect produced by the sprays.

Measurement of vibration amplitude at a single frequency is sufficient, and the preferred means for sensing the vibration is a piezo-electric member which is influenced by the vibration of the vibratable element so as to emit a signal at the frequency of vibration of the element.

The measurement of vibration amplitude has been found to be by far the most satisfactory method of checking the spray operation; other methods considered are (i) measurement of flow rate of the water supply to the spray nozzles, (ii) use of capacitative effects, e.g. changes of a dielectric caused by the sprayed water, (iii) pressure measurement (see above) and (iv) measurement of the temperature decrease of a heated wire, when subjected to the water spray.

The detector for vibrational amplitude can be of a small size, so that a large number of detectors can be used in a row across the carriage, leading to a detailed picture of the functioning of the sprays.

Use of the checking apparatus of the invention can take place between the casting of two charges and can be performed as frequently as is deemed necessary. It is thereby ascertained whether each spray is functioning or not, and if so, whether it is functioning properly. It is a particular advantage that the apparatus is guided through the roll track in the same way as a slab, so that information is obtained directly about the cooling of a slab by the spray systems. From the information obtained from the measurement, the decision can be taken as to whether to replace sprays which are not functioning efficiently.

The apparatus should preferably be moved at a constant velocity along the roll track. Although it is feasible that the carriage could be provided with its own drive means, such as for example drive wheels or rollers or a conveyor belt, this complication should preferably be avoided, and use made of the dummy bar already present in the casting machine. The carriage can be connected to this bar and guided through the casting path during a period of time which corresponds to the period required for measurement.

For the processing of the measuring signals, it is feasible that these should be recorded or even processed in the moving carriage. However, it is preferred to take the signals out by means of a cable to processing apparatus outside the double roll track. One advantage of this is that the carriage which is already fragile and complicated is kept as simple as possible. Another advantage is that processing does not need to take place in separate processing apparatus located in the carriage, but instead the signals can be processed in existing data-processing apparatus which is also used for other purposes. Yet a further advantage is that if only recording is undertaken in the carriage, then a direct start can be made on processing without needing to wait for the end of the measuring cycle.

From the results of the processing of the signals, it is for example possible for sprays which are not functioning, or not functioning properly, to be disconnected. Furthermore a visual image of the spray pattern can be provided showing the number and concentration of sprays which are either not functioning or are not functioning properly. Data-processing apparatus capable of handling the signals from the apparatus of the invention is generally known, and need not be described in this specification.

As mentioned above, the sensing means for the vibration of the vibratable element is preferably a piezo-electric member. In this case, the vibratable element is preferably a metal diaphragm, since this has adequate durability and speed of response. Conveniently the diaphragm is a metal disc forming an end wall of a cylinder, the disc and cylinder being in one piece and the piezo-electric member being mounted on the disc inside the cylinder, the cylinder being sealed at its other end. The piezo-electric member and its electrical connections are thus sealed in an enclosed space. Vibrational isolation of the diaphragm from shocks to the carriage can conveniently be achieved, as described below.

The frequency of vibration of the vibratable element should be carefully selected to be in the range above that of the noise and vibration to which in use the carriage is likely to be subjected, and below that at which no useful vibration of the element is caused by the sprayed liquid. The preferred range is 5 to 100 kHz.

To protect the detectors, it is preferred that they are located in a recess in the carriage. Where there are detectors on both sides of the carriage (i.e. facing up and down when the carriage is moving horizontally), it is preferred that the detectors on one side are shielded from the liquid impinging on, and bouncing off, the detectors on the other side.

Where the spray nozzles are arranged in a row extending transversely of the path of movement of the carriage, it is preferred that the detectors are also in a transverse row and that there are at least twice as many detectors as spray nozzles, in order to obtain adequate information about the mal-functioning of the nozzles.

BRIEF INTRODUCTION OF THE DRAWINGS

Embodiments of the invention will be described below by way of example with reference to the accompanying drawings, in which.

DESCRIPTION OF THE PREFERRED EMBODIMENTS

Figure 1:
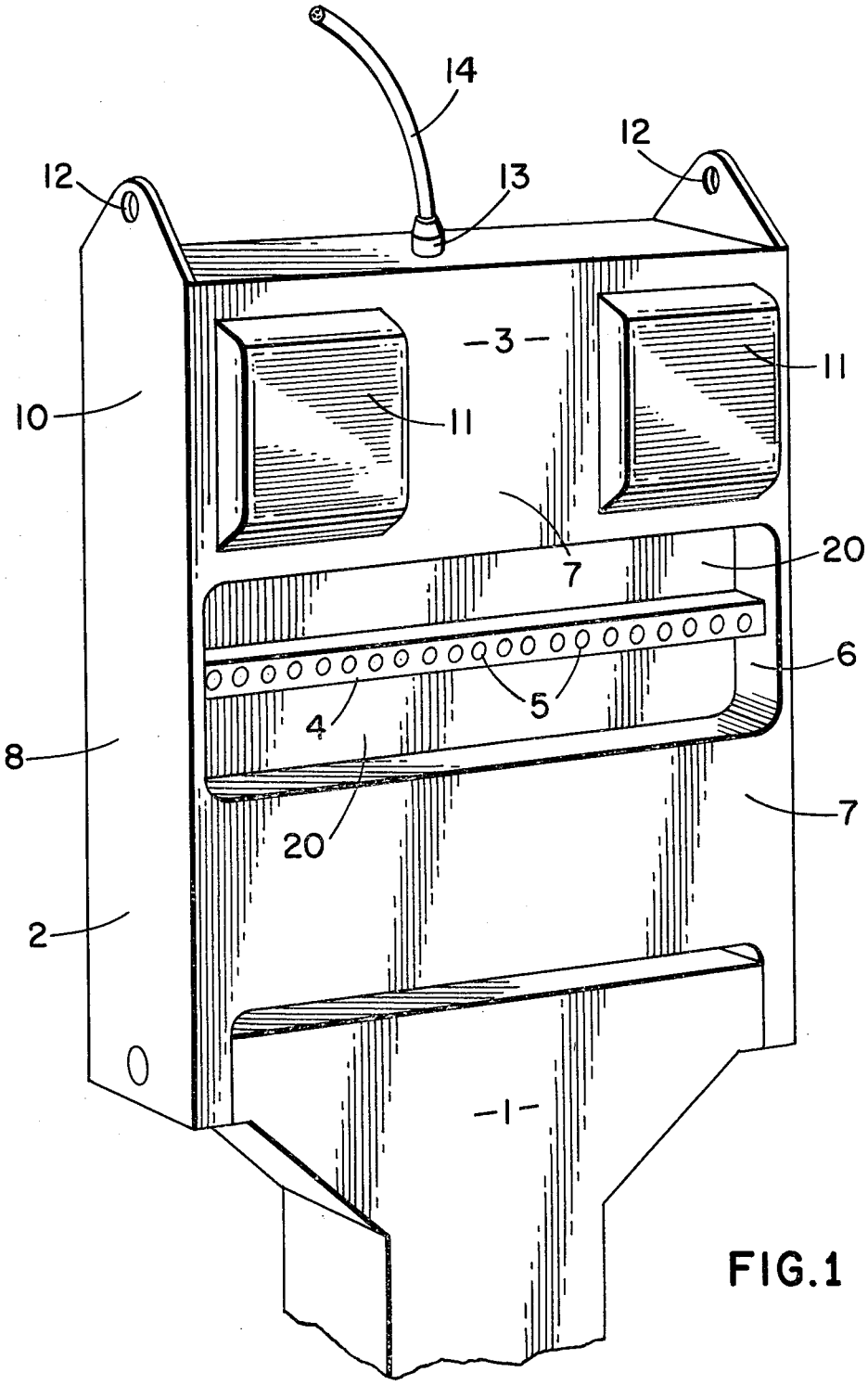
FIG. 1 is a perspective view of one preferred form of checking apparatus embodying the invention.

FIG. 1 shows the end of the dummy bar 1 of the continuous casting machine to which a portion 2 of a carriage 3 of the checking apparatus is hingedly connected. The carriage 3 has a measuring arm 4 which on the face visible in FIG. 1, and on the rear face not shown in FIG. 1, is provided with a plurality of measuring devices 5. The measuring arm 4 is mounted in an aperture 6 through the carriage 3, which is provided with shields 20. The front and rear faces of the measuring arm 4 are thus recessed with respect to the faces of the carriage (e.g. the surface 7 visible in FIG. 1). The measuring arm 4 is connected with the portion 2 of the carriage 3 by means of the side panels 8.

The side panels 8 also contain the electric cables (not shown) by means of which the signals which are emitted by the measuring devices 5 are led to the section 10 of the carriage 3. This section 10 is a closed space in which electronic circuitry is provided for processing the measured signals. The cable 14, by means of which the signals are taken out of the carriage to external data-processing means is connected by plug 13 with the carriage 3.

The section 10 of the carriage 3 is provided with lifting eyes 12. On the face 7 visible in the drawing, and on the rear face which is not visible, the carriage is provided with guide means 11, in the form for example of shoes or gas-filled guide pads.

Figure 2:
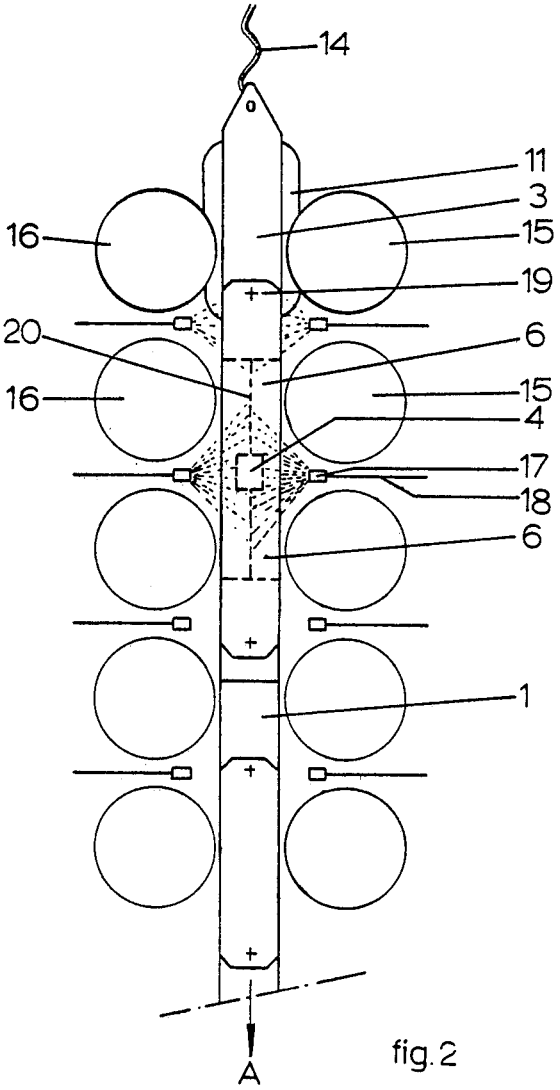
FIG. 2 is a side view of the embodiment of FIG. 1, in a slightly modified form.

FIG. 2 shows a portion of the double roll track of the continuous casting machine comprising opposed pairs of rolls 15, 16. Between the rolls on each side of the track are rows of water sprays 17, fed with water by pipes 18.

In use, the carriage 3 is moved along the roll track by means of the dummy bar 1 in the direction shown by the arrow A. FIG. 2 shows the measuring devices on the measuring arm 4 lying exactly between two opposed rows of sprays 17. The open space 6 in the carriage ensures that the sprayed water does not build up, as it can easily flow away from this space 6.

The following remarks can be made regarding the dimensions of the carriage 3. Its width should correspond essentially with the maximum width of the slabs to be cast. With the dimensions already mentioned for a slab of 2000×250 mm, the width of the carriage should thus be about 2000 mm. Its thickness should be such that, allowing for the curvature of the curved portion of the roll track, it can be moved between the rolls without jamming. If required the carriage itself can also be designed as a chain, with articulated links connected at the point 19 as shown in FIG. 2. With slab dimensions of 2000 and 250 mm, the carriage 3 should not exceed a thickness of 200 mm. During its movement along the roll track, care should be taken that the carriage is moved as far as possible in the centre of the track, so that the signals obtained can be properly interpreted. For this purpose the guide means 11 are provided to ensure that the carriage remains properly in the centre of the double roll track. For design reasons, in the case of apparatus suitable for slab dimensions of 2000 and 250 mm, the length of the carriage should be about 1 meter.

The apparatus may be used as follows. Whilst the end of the dummy bar 1 still projects above the mould of the casting machine (not shown) the carriage 3 is connected to the bar, and by means of lifting eyes 12, is lowered into the mould. Before the carriage has completely disappeared into the mould, the cable 14 is attached to it by means of the plug 13. Subsequently, whilst the sprays are connected to a supply of liquid, the carriage is moved by the dummy bar along the roll track. The signals emitted by the measuring devices 5 are led out via measuring cable 14, to be processed into suitable form.

Figure 3:
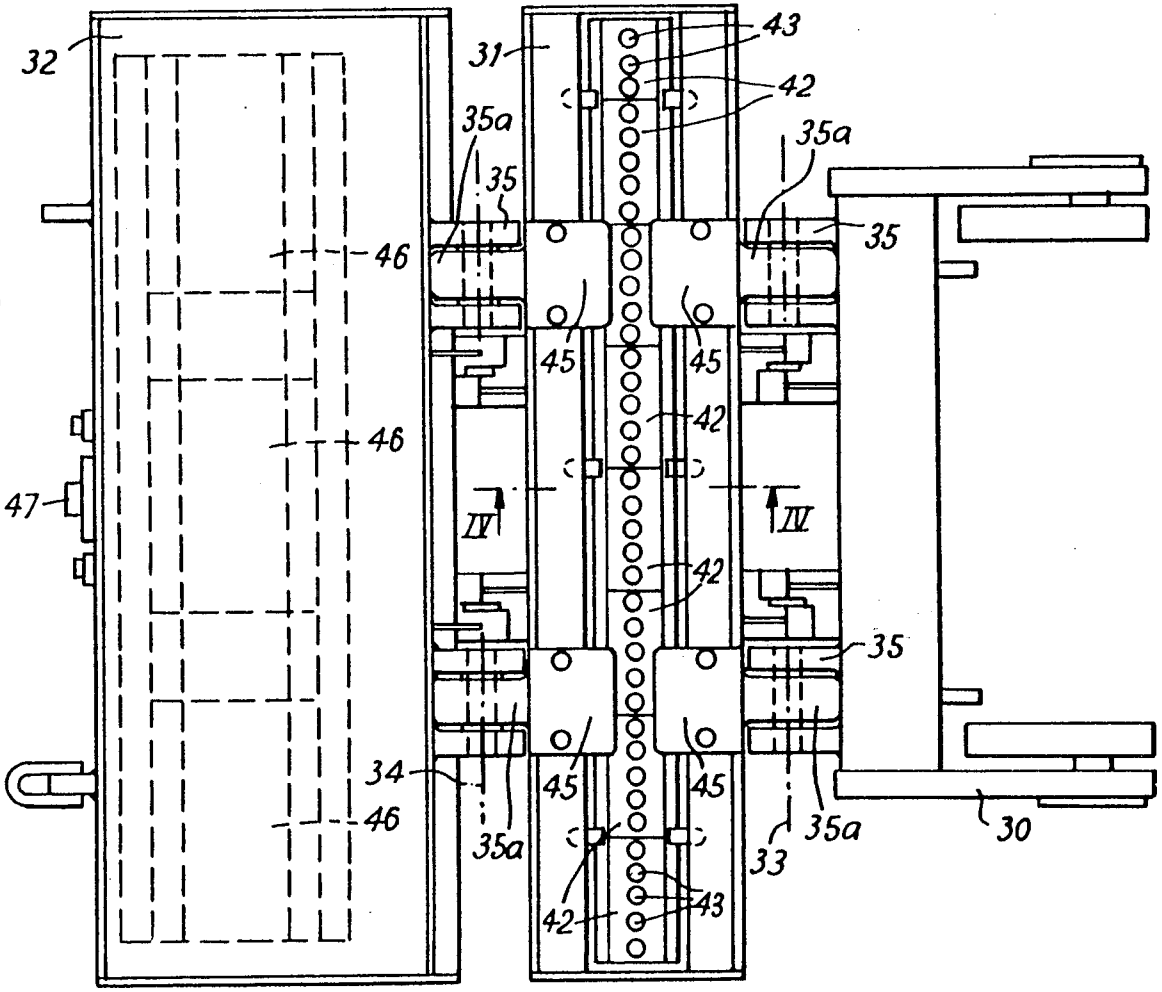
FIG. 3 is a top view of a second checking apparatus embodying the invention.
Figure 4:
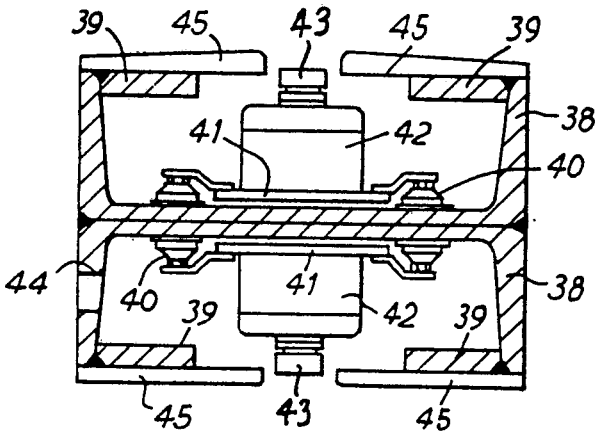
FIG. 4 is a cross section of the embodiment of FIG. 3 on the line of IV—IV of FIG. 3, on a larger scale.
Figure 5:
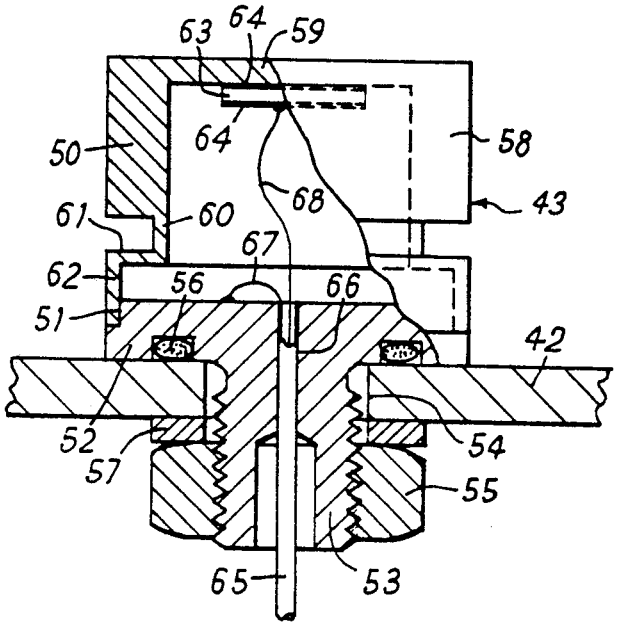
FIG. 5 is an axial sectional view of a single detector of the checking apparatus of both embodiments.

The embodiment of the invention shown in FIGS. 3 to 5 is similar to that shown in FIG. 2, but here the carriage consists of three parts 30,31,32 articulated to each other at axes 33,34 by means of pivotally connected brackets 35,35*a*. The leading part 30 serves only to attach the apparatus to the last link of the dummy bar of the continuous casting apparatus (not shown).

The central part 31 carries the detectors 43 in a single straight transverse row, the position of each detector 43 being marked by a circle. The part 31 consists of two channel section members 38 (FIG. 4) joined back-to-back by welding and having inwardly turned strips 39 welded at each of their extremities. Mounted within each channel 38 by means of vibration damping mountings 40 is a plate 41 which carries a plurality of boxes 42 on which the detectors 43 are mounted. FIG. 3 shows that there are eight boxes, seven of which each carry five detectors 43 and the other one of which carries three detectors. The electrical connections to the boxes 42 are not shown, but pass out of the boxes through suitable unions and are led away through apertures 44 in the channels 38. To protect the heads of the detectors 43 from guides which are used when introducing the dummy bar and the checking apparatus into the roller path, the channels 38 also carry shields 45. It is to be noted however that the heads of the detectors 43 are recessed only by a small amount below the level of the outer surfaces of the shields 45, in order that the shields 45 do not significantly interfere with the detection of the sprayed water by the detector 43. Apertures (not shown) are provided in the members 38 to allow the sprayed water to flow away.

The third part 32 of the apparatus is a closed box containing within it three boxes 46 themselves containing electrical and electronic equipment (e.g. a multiplexer) which scans the detectors 43 sequentially and provides a suitable output which is taken by cabling out through the union 47 to the signal processing apparatus which is not shown.

The detector 43 is shown in detail in FIG. 5. It consists of an upper part 50 of brass which is secured and sealed by adhesive at 51 to a lower part 52 also of brass which has a threaded shank 53 passing through an aperture 54 in the box 42, the part 52 being secured by a nut 55 on the shank. A sealing ring 56 and a washer 57 seal the interior of the detector from the exterior.

The upper part 50 has a relatively thick cylindrical wall 58 which is closed at its upper end by a disc 59 which forms the vibratable diaphragm. At the other end of the cylinder 58 is a thin cylindrical portion 60 which connects the cylinder 58 to the inner edge of a radial flange 61 which in turn is connected at its outer edge to a thin cylindrical portion 62 which is adhesively secured to the lower part 52 at 51 as mentioned above. The arrangement of the thin walls 60,61 and 62 provides a spring which together with the mass of the heavier cylindrical part 58 and the disc 59 constitutes a mass-spring system which is designed to isolate the disc 59 from vibration due to shocks which might otherwise be transmitted to the disc 59 via the box 42.

Adhesively secured to the inside face of the disc 59 is a piezo-electric element 63 having on its opposite faces silver electrodes 64. One electrode 64 is thus electrically connected to the disc 59 and thereby to the lower part 52. A coaxial cable 65 enters the enclosed space within the cylinder 58 via a bore 66 in the lower part 52 and is sealed to the walls of the bore 66. The metal sheathing 67 of this cable is connected to the lower part 52 and the central wire 68 to the second electrode 64.

Drops of water impinging on the disc 59 set it in vibration, and the vibration causes stretching and contraction of the piezo-electric element 63 secured to the disc resulting in an electrical output voltage across the element 63 of a frequency equal to the natural resonant frequency of vibration of the disc 59. In the particular example illustrated, this frequency is about 26 kHz. The amplitude of the signal produced by the element is related (not exactly linearly) to the number, velocity and weight of the water droplets impinging on the disc 59, and it is therefore this amplitude which is detected and analysed in order to provide an indication of the spraying conditions at any time at the detector 43.

Since the output of the piezo-electric element is extremely small, the boxes 46 contain an amplifier (not shown) for each detector 43, to provide a suitable output for processing in the part 32 and transmission to the external electronic analysis apparatus.

FIG. 5 shows how the upper part 50 is made in one piece from brass. After the wires of the coaxial cable have been connected to the lower part 52 and the electrode of the piezo-electric element, the upper part 50 is sealingly attached to the lower part 52 at a temperature close to 0° C., in order that condensation shall not form within the cylinder 58, if the apparatus should subsequently be employed under cold conditions.

The piezo-electric element is suitably a lead zirconate titanate ceramic. Piezo-electric devices similar in principle to that illustrated in FIG. 5 have been designed previously for use in the transmission and reception of ultrasonic waves in air, though in the development of the present invention it was found that these particular devices are unsuitable for the present purpose.

Figure 6:
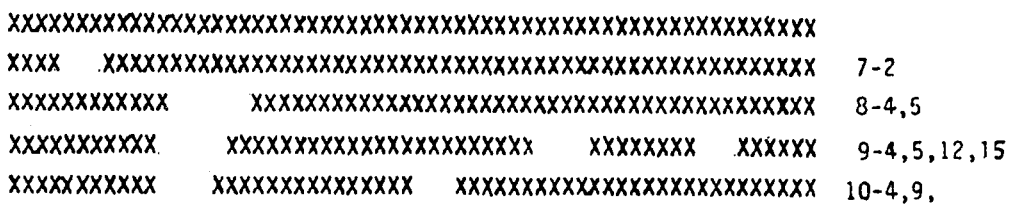
FIG. 6 is a diagram illustrating one form of presentation of the results of operation of the checking apparatus.

FIG. 6 shows one convenient form of presentation of the results of a run of the checking apparatus of the invention through the roller track of a continuous casting machine. The horizontal rows represent the successive rows of spraying nozzles passed by the checking apparatus, from the sixth row to the twenty-fourth (the number of the row is the first number given at the right hand side of each row). Each X in each row is representative of the output of an individual detector when located by the given row of nozzles and the absence of an X indicates that the spraying effect at the detector in question was below a predetermined level or non-existent (as indicated above the detector is sensitive to number, velocity, and weight of the sprayed droplets). The figures given by each column to the right hand side of the hyphen indicate the spray nozzles in that row that are not operative or are operating but in a faulty manner. Thus in the seventh row the second spray is not functioning correctly, and this is indicated by the absence of three X's in the appropriate position. It can be seen from FIG. 6 that there are about three or four detectors for each spray nozzle. A printed output in this form is provided by a simple data processing procedure, from the signals dispatched by the checking apparatus embodying the invention.

In an alternative embodiment, the checking apparatus (vibratable element and sensors) is a part of the dummy bar, so that a check of the sprays is performed at the beginning of each casting operation.

While the invention has been illustrated above by reference to some embodiments thereof, it is to be understood that many other embodiments are feasible, within the spirit and scope of the following claims.

What is claimed is:

1. In apparatus for checking the operation of a plurality of liquid sprays which are arranged along a path to spray liquid onto an object moving along said path, the apparatus comprising a carriage adapted to be moved along said path and a plurality of detectors for the sprayed liquid arranged across the carriage so as together to detect the sprayed liquid across the width of the path, the improvement that each of said detectors comprises an element capable of vibration which in use is exposed to the sprayed liquid so as to be set in vibration thereby and sensing means adapted to sense the vibration of said element and to provide an output in dependence on the amplitude of the vibration.

2. Apparatus according to claim 1 wherein the sensing means comprises a piezo-electric member connected to said element so as to provide an electrical output in dependence on the vibration of the element.

3. Apparatus according to claim 2 wherein said element is a metal diaphragm.

4. Apparatus according to claim 3 wherein said diaphragm is a metal disc forming an end wall of a cylinder, the disc and cylinder being in one piece and the piezo-electric member being mounted on the disc inside the cylinder, the cylinder being sealed at its other end.

5. Apparatus according to claim 4 wherein at the end of the cylinder opposite the disc the cylinder is connected all around its axis to one edge of a wall extending radially with respect to the cylinder and formed in one-piece with the cylinder, said wall in turn being supported at its other edge, the wall thereby providing vibrational isolation of the cylinder.

6. Apparatus according to any one of claims 1, 2 and 3 wherein the natural vibration frequency of the said element is in the range 5 kHz to 100 kHz.

7. Apparatus according to any one of claims 1, 2 and 3 wherein there is a plurality of detectors arranged in a row on each of opposite sides of the carriage, and on each side the detectors are arranged in a recess in the carriage, the detectors on each side being shielded from the liquid sprayed onto the detectors of the other side.

8. In combination, apparatus for spraying liquid onto an object movable along a path having a plurality of rows of spraying nozzles extending transversely with respect to the direction of movement of the object along the path, apparatus for checking the operation of the sprays comprising a carriage adapted to be moved along said path and a plurality of detectors for the sprayed liquid arranged across the carriage so as together to detect the sprayed liquid across the width of the path, each of said detectors comprises an element capable of vibration which in use is exposed to the sprayed liquid so as to be set in vibration thereby and sensing means adapted to sense the vibration of said element and to provide an output in dependence on the amplitude of the vibration wherein the detectors are arranged in at least one row across the said carriage and the number of detectors in the row across the carriage is at least twice the number of spraying nozzles in a row.

9. A combination according to claim 8 including a plurality of opposed pairs of rolls disposed along said path, the spraying nozzles being arranged in rows located beside the path between adjacent rolls on each side of the path and said object is a cast slab of steel.

10. Apparatus for continuous casting of steel, comprising (a) a mould adapted for continuous casting;

(b) a plurality of opposed pairs of rolls spaced apart so as to define a path extending between the two rolls of each pair for passage of a continuously cast solidifying steel slab from the mould;

(c) a plurality of spraying nozzles arranged in a plurality of rows between adjacent said rolls on each side of the said path and adapted to spray water onto the solidifying steel slab;

(d) a dummy bar adapted to be passed along said path at the head of the continuously cast slab;

(e) means for checking the operation of the said spraying nozzles comprising (i) a carriage adapted to be connected to the dummy bar so as to follow the dummy bar along said path, (ii) a plurality of detectors mounted on the carriage and arranged in two rows extending transversely of said carriage respectively on opposite sides of the carriage, each said detector, comprising a metal diaphragm which is exposed to the sprayed water from the nozzles and is adapted to be vibrated by the sprayed water and piezo-electric sensing means connected to said diaphragm and adapted to emit a signal dependent upon the amplitude of the vibration of the diaphragm, the number of detectors in each said row thereof being at least twice the number of said spraying nozzles in any row thereof on the respective side of the said path, (iii) means for receiving and analysing the outputs of the piezo-electric elements of the detectors.

* * * * *